United States Patent [19]

Naoki et al.

[11] Patent Number: 4,820,550

[45] Date of Patent: Apr. 11, 1989

[54] PROCESS FOR PRODUCING A SHEET OF COLOR-DEVELOPER FOR PRESSURE-SENSITIVE RECORDING PAPER

[75] Inventors: Makoto Naoki; Shouzou Aoyagi, both of Iwaki, Japan

[73] Assignee: Kureha Kagaku Kogyo Kabushiki Kaisha, Tokyo, Japan

[21] Appl. No.: 105,182

[22] Filed: Oct. 6, 1987

[30] Foreign Application Priority Data

Oct. 16, 1986 [JP] Japan ..... 61-244239

[51] Int. Cl.[4] ..... B41M 5/16

[52] U.S. Cl. ..... 427/150; 427/151; 428/914; 503/209; 503/213; 503/214; 503/225

[58] Field of Search ..... 427/150–152; 428/914; 503/200, 213, 216, 225, 209, 214, 215

[56] References Cited

U.S. PATENT DOCUMENTS 4,069,353 1/1978 Matsukawa et al. ..... 427/150
4,562,116 12/1985 Okada et al. ..... 503/215
4,601,920 7/1986 Mitsuo et al. ..... 427/150
4,670,344 6/1987 Okada et al. ..... 503/215

FOREIGN PATENT DOCUMENTS 54-143322 11/1979 Japan ..... 503/213
2136467A 9/1984 United Kingdom ..... 503/213

*Primary Examiner*—Bruce H. Hess
*Attorney, Agent, or Firm*—Nixon & Vanderhye

[57] ABSTRACT

Disclosed herein is a process for producing a sheet of a color-developer for a pressure-sensitive recording paper, which process comprises the steps of dissolving an organic color-developer in an organic solvent, dispersing the formed solution into water, thereby forming minute liquid droplets with a diameter of 0.01 to 2 μm, removing the solvent in the liquid droplets by heating while taking care not to cause any coalescence of the droplets and also any unstabilization of the emulsion, thereby forming a slurry comprising the minute granules of the color-developer and applying the slurry on a supporting sheet.

7 Claims, No Drawings

PROCESS FOR PRODUCING A SHEET OF COLOR-DEVELOPER FOR PRESSURE-SENSITIVE RECORDING PAPER

BACKGROUND OF THE INVENTION

The present invention relates to a process for producing a sheet of color-developer for pressure-sensitive recording paper.

The present invention also relates to a process for producing a sheet of color-developer for pressure-sensitive recording paper, which has a large initial color developing speed and a favorable light-resistance of the developed image and on which a color-developer has been uniformly applied.

Further, the present invention relates to a process for producing a sheet of color-developer for pressure-sensitive recording paper. The process includes a step of applying slurry, which contains an organic color-developer in granule forms with diameters of 0.01 to 2 μm, on a supporting sheet.

Hitherto, a pressure-sensitive recording paper comprises (1) an upper sheet of paper produced by dissolving a color-former in a solvent, microcapsulating the solution and applying the microcapsules on the lower surface of the sheet, (2) a lower sheet of paper produced by applying a color-developer on the upper surface of the sheet and (3) an intermediate sheet of paper produced by applying a color-developer on the upper surface and microcapsules on the lower surface of the sheet. A combination of the upper sheet and the lower sheet or a combination of the upper sheet, the intermediate sheet and the lower sheet is actually used as the pressure-sensitive recording paper. When a printing pressure or a writing pressure is applied on a pressure-sensitive recording paper, the microcapsules are ruptured and the color-former is brought into reaction with the color-developer, thereby the image is formed.

As a color-developer for a pressure-sensitive recording paper, an inorganic compound such as kaolin, activated clay and Japanese acid clay and an organic compound such as phenol-formalin resin, for instance, a condensate of p-phenylphenol and formalin, an aromatic carboxylic acid, for instance, 3,5-t-butylsalicylic acid and its metallic salt, for instance, zinc 3,5-t-butylsalicylate, have been generally used.

However, when an inorganic compound such as kaolin, activated clay or Japanese acid clay is used as the color-developer, there are the defects that the light-resistance, the water-proofness and the time-dependent stability of the colored image are poor. Further, the phenol-formalin resin has the defects that the light-resistance is poor and the color-developing speed is slow although the water-proofness is good. On the other hand, although the aromatic carboxylic acid or its metal salt is used for removing the above defects, such a material cannot be sufficient in color-developing speed. Accordingly, when producing a sheet of color-developer, several methods have been devised and recently, an improvement of the sheet of color-developer as a system including a selection of the color-former or a better combination of color-former and its solvent has been requested.

In general, as a method for improving the color-developing speed, the step of pulverizing the particles of the color-developer and thereby increasing the surface area of the particles has been taken, while applying a wet-type pulverizer such as sandmill, attritor, ball mill, etc. or a dry-type pulverizer, as a general method.

However, applying the above pulverizing methods, the pulverization is limited to the extent of 1 to 5 μm in average, and the presence of the particles larger than 10 μm is inevitable.

Further, a method of dissolving the color-developer in a solvent and emulsifying the formed solution, thereby micronizing the color-developer has been proposed recently (refer to Japanese Patent Application Laid-Open (KOKAI) No. 54-143322/1979).

However, according to this method, there are problems that the amount of the solvent is large, at the time of using the color-developer in recording, the "fog" is formed on the pressure-sensitive recording paper and this light-resistance is deteriorated. Then, as an improvement of the above method, a method of using the color-developer micronized by emulsifying and admixed with the mechanically pulverized color-developer obtained by the above pulverizing apparatus has been disclose lately (refer to GB patent No. 2,136,467A).

As a result of the present inventors' intensive studies for removing the above defects of the sheet of color-developer, it has been found out that the aptitude for coating the color-developer is improved by forming its minute and uniform particles and that the pressure-sensitive recording paper with the sheet coated with thus improved color-developer has a large initial color-developing speed and the favorable light-resistance of the image developed, and based on these findings, the present invention has been completed.

SUMMARY OF THE INVENTION

The object of the present invention lies in the production of a sheet of an organic color-developer for a pressure-sensitive recording paper, having a large initial color-developing speed and an excellent light-resistance of the developed image.

Further, the object of the present invention lies in the production of the sheet of an organic color-developer, for a pressure-sensitive recording paper, produced by using an aqueous slurry of micronized organic color-developer.

DETAILED DESCRIPTION OF THE INVENTION

The feature of the present invention lies in the steps of dissolving an organic color-developer, for a pressure-sensitive recording paper, in an organic solvent, adding the solution of the color-developer into an aqueous solution dissolving a surfactant and a water-soluble high polymer in the summed amount of 0.2 to 50 parts by weight to 100 parts by weight of the organic solution, emulsifying the aqueous mixture and forming minute liquid droplets of 0.01 to 2 μm in diameter containing the color-developer, heating the emulsion comprising the minute liquid droplets under agitation, thereby removing the organic solvent and applying the obtained slurry of the color-developer on a supporting sheet.

Namely, it is important in the present invention to dissolve the organic color-developer in an organic solvent and to form the minute liquid droplets of 0.01 to 2 μm in diameter by emulsifying the solution of the color-developer in water and for that purpose, it is necessary to dissolve the organic color-developer in an organic solvent first, to add the solution of the color-developer to an aqueous solution into which a surfactant and a water-soluble high polymer have been dissolved in a summed amount of 0.2 to 50 parts by weight to 100 parts by weight of the solution and to emulsify the mixture of the solution and water at a desired temperature.

The organic solvent used here has a property of a boiling point of not higher than 170° C, preferably not higher than 150° C at an atmospheric pressure, or has a property of forming an azeotropic mixture with water, not dissolving into water more than 5% at room temperature and dissolving an organic color-developer not less than 10%, preferably not less than 20%, at a heating temperature for removing the solvent after emulsification. The amount of dissolution of an organic color-developer in an organic solvent is preferable when it is as much as possible, and among the solvents, there is a solvent which dissolves a color-developer as much as 80%.

When the organic solvent has a boiling point of over 170° C and does not form any azeotropic mixture with water, the heating temperature for removing the solvent after emulsification becomes higher and as a result, the coalescence of the liquid droplets in the emulsion become frequent and the amount of water evaporated becomes uneconomically large. Further, when using an organic solvent which dissolves in water more than 5%, the emulsion becomes unstable at the emulsification and also at the time of removing the solvent.

As an organic solvent used in the present invention, aromatic hydrocarbons such as benzene, toluene, etc; halogenated hydrocarbons such as trichloroethane, dichloroethane, chloroform, carbon tetrachloride, etc.; ketone such as methyl isobutyl ketone, diethyl ketone, etc. and esters such as n-butyl acetate, isobutyl acetate, etc. can be exemplified.

These solvents can be used singly or after mixing not less than two kinds of the solvents and it is possible to reduce the boiling point of the solvent substantially by adding another solvent of which mixture forms an azeotropic composition.

A color-developer to be used should be dissolved in these solvents in amount of not less than 10%, preferably not less than 20%.

In the next place, the solution of the organic color-developer in the organic solvent is added to the aqueous solution of the specified amounts of the surfactant and the water-soluble high polymer and the mixture is emulsified. At that time, it is suitable that the weight ratio of the surfactant to the water-soluble high polymer is in the range of 0.2 to 4, preferably 0.5 to 3. It also is suitable to use 0.1 to 10 parts by weight, preferably 0.5 to 9 parts by weight of the surfactant and to use 0.1 to 40 parts by weight, preferably 1 to 27 parts by weight of the water-soluble high polymer to 100 parts by weight of the solution of the color-developer.

Further, the solution of the color-developer is added to water in an amount of 10 to 140%, preferably 30 to 100%, and the mixture is emulsified. At the time of emulsification, it becomes possible to prepare a stable emulsion by using an ionic or non-ionic surfactant and, as a protective colloid, a water-soluble high polymer.

As the surfactant used here, salts of an alkylbenzenesulfonic acid, salts of a dialkylsulfosuccinic acid, salts of an alkylsulfuric acid, salts of a polyoxyethylene alkyl ethersulfuric acid, salts of a polyoxyethylene alkyl phenol ethersulfuric acid, condensates of naphthalenesulfonic acid and formalin and salts thereof can be exemplified. The number of the carbon atoms of the alkyl group of the above compounds is preferably 8 to 18 in the salt of alkylbenzenesulfonic acid, 4 to 8 in the salt of dialkylsulfosuccinic acid, from 8 to 22 in the salt of alkylsulfuric acid, from 8 to 18 in the salt of polyoxyethylene alkyl ethersulfuric acid and 8 to 10 in the salt of polyoxyethylene alkyl phenol ethersulfuric acid. Besides, as the salt, sodium salt, potassium salt, magnesium salt and calcium salt can be exemplified.

As a concrete example of the water-soluble high polymer, polyvinyl alcohol, copolymers of ethylene and maleic anhydride, copolymers of styrene and maleic anhydride, methylcellulose, hydroxyethylcellulose, carboxymethylcellulose, resins of acrylic ester, etc. can be mentioned.

According to the present invention, it is possible to form the minute particles (minute liquid droplets) of the color-developer of 0.01 to 2 μm in diameter by adding the solution of the color-developer in an aqueous solution in which the surfactant and the water-soluble high polymer in the summed amount of not less than 0.2 part by weight and not more than 50 parts by weight, preferably not less than 1.5 parts by weight and not more than 36 parts by weight to 100 parts by weight of the solution and emulsifying the mixture. Further, it is preferable to make the diameter of the minute particles about 0.05 to about 1.0 μm.

In this emulsification, the ratio of the viscosity of the solution of the organic color-developer to the viscosity of the aqueous solution of the surfactant and the water-soluble high polymer is suitably made to be 0.1 to 10, preferably 3 to 5 at the emulsifying temperature, and as the method for emulsifying, a method of stirring at a high speed (a peripheral velocity of not less than 15 m/sec.), a method of emulsifying under a high pressure or a method of emulsifying by supersonic wave is preferable and according to a necessity, these methods can be combined or a preliminary emulsification can be applied.

According to the present invention, the emulsified liquid is heated to remove the solvent from the liquid comprising the minute liquid droplets of 0.01 to 2 μm in diameter, which has been obtained by the emulsification, and at that time, the solvent should be slowly distilled out by heating the emulsified liquid under agitaiton in order to prevent the flocculation and the coalescence of the minute liquid droplets. Since the rapid heating and distillation are the main causes of the coalescence of the liquid droplets, they should be avoided. Further, according to necessity, it is also possible to distill the solvent out under a reduced pressure. Moreover, when the solvent has a boiling point of not lower than 100° C under the atmospheric pressure and does not form any azeotropic mixture with water, it is preferable to remove the solvent by steam distillation.

By removing the solvent from the emulsified liquid in this manner, a slurry of the color-developer is obtained. The slurry comprises the minute particles of color-developer and scarcely contains the solvent, therefore, even in the case of applying the slurry onto the sheet of paper of fine quality as a supporting sheet, the phenomenon of infiltration of the color-developer into the sheet of paper, etc. is not recognized.

When the slurry of the color-developer thus obtained is applied on the supporting sheet, with an inorganic pigment, for instance, calcium carbonate, aluminum hydroxide, zinc oxide, titanium oxide, silicon oxide, calcium oxide, kaolin, talc, barium sulfate, etc., the effects of improving the application aptitude and the power of concealing are obtained and raising the color-developing capability is available.

By the way, as a binder of the color-developer to the supporting sheet, the water-soluble high polymer, which has been used at the time of emulsification, can be effective by itself, however, the use of a natural or synthetic high polymeric substance in combination with the water-soluble high polymer is also possible.

As a natural or synthetic high polymeric substance, for instance, latices such as a copolymer latex of styrene and butadiene, polyvinyl alcohol, copolymer of ethylene and maleic anhydride, copolymer of styrene and maleic anhydride, gum arabic, gelatine, starch, methylcellulose, etc. may be exemplified.

Further, the color-developer used according to the present invention can be selected from conventional organic color-developers soluble in an organic solvent, and the phenol-formalin resins, the aromatic carboxylic acids and the metal salts thereof may be exemplified.

Namely, as a phenol-formalin resin, those obtained by thermally condensing a phenol and formalin or paraformaldehyde in the presence of an acidic catalyst may be mentioned, and in that case, as a phenol, p- and m-phenylphenol, phenol, p-cresol, p-dodecylphenol, etc. may be exemplified. On the other hand, as an aromatic carboxylic acid, 3,5-di-t-butylsalicylic acid, 3,5-diamylsalicylic acid, 5-t-butylsalicylic acid, 3,5-di-sec-butylsalicylic acid, 3,5-di-α-methylbenzylsalicylic acid, 2-hydroxy-5-t-butylbenzoic acid, 2-naphthoic acid, etc. may be exemplified. As a metal salt of the aromatic carboxylic acid, the salts of copper, lead, magnesium, calcium, zinc, aluminum, etc. may be exemplified.

These color-developer is favorably applied on a supporting sheet in an amount of 0.1 to 5.0 g/m$^2$, preferably 0.2 to 2.0 g/m$^2$.

When the sheet of color-developer according to the present invention is used as a pressure-sensitive recording paper, a color-former which reacts with the color-developer is not particularly restricted. As such color-former, 3,3-bis(p-dimethylaminophenyl)-6-dimethylaminophthalide; 3,7-bis(dimethylamino)-10-benzoylphenothiazine; 3-diethylamino-6-methyl-7-anilinofluorane; 2-anilino-3-methyl-6-(N-ethyl-p-toluidino)-fluorane; 3-N-cyclohexyl-N-methylamino-6-methyl-7anilinofluorane; 3-(N,N-diethylamino)-7-(N,N'-dibenzylamino)fluorane; 2-(N-phenyl-N-methylamino)-6-(N-p-tolyl-N-ethyl)aminofluorane; 3,6-bis(diethylamino)-fluorane-γ-anilinolactam; 3-diethylamino-6 -methyl-7-chlorofluorane; 3-diethylamino-6,8-dimethylfluorane, etc. may be exemplified. These compounds can also be used as a mixture of not less than the two members.

In this connection, the color-former is dissolved in a solvent and microcapsulated according to a conventional method and after adding a binder, the color-former is applied on a supporting sheet.

As a solvent for the color-former, alkylated naphthalene, alkylated biphenyl, hydrogenated terphenyl, diarylethane, triarylmethane, chlorinated paraffin can be mentioned. Concerning the method of microcapsulation, a method generally carried out hitherto such as a coacervation method, a method of interfacial polymerization, an in situ method, etc. can be used. As the concrete example of the method of microcapsulation, the method described in EP-46415 can be mentioned.

As has been described above, since the color-developer ( a slurry form) for the pressure-sensitive recording paper, which is prepared according to the present invention, has a remarkably small particle diameter and scarcely contains a remaining organic solvent, when the sheet of the color-developer obtained according to the present invention by applying the slurry on a supporting sheet is brought into contact with the upper sheet of paper, on which the microcapsules containing a color-former has been applied, and a load is applied on the piled sheets with a calender roll to develop a color, the speed of color-development is large as will be seen in the test results in Examples, and even when the color-developed recording paper and the not yet color-developed recording paper are exposed to sunlight for 4 hours, the color change of the paper to yellow and their discoloration are small. Accordingly, the present invention is useful in the improvement of the quality of the pressure-sensitive recording paper.

The present invention and the effect thereof will be concretely explained while referring to the following non-limitative Examples.

The word "part" in Examples means the part by weight as far as not being particularly mentioned.

EXAMPLE 1

Into 50 parts of methyl isobutyl ketone (MIBK), 50 parts of p-phenylphenol-formalin resin (made by GUNEI Chemical Co., under the mark of PS-2881) were added and the resin was dissolved in MIBK at 70° C. Separately, into 50 parts of an aqueous 5% solution of ethylene-maleic anhydride copolymer (made by MONSANTO Co., under the mark of EMA-21), 180 parts of water were added and further, 18 parts of an aqueous 10% solution of sodium polyoxyethylene alkylphenol ether sulfate (made by KAO Co., under the mark of LEVENOL ® WZ) were added, as the surfactant, to the mixture and made its pH to 4 with an aqueous 20% solution of sodium hydroxide. Said solution of p-phenylphenol-formalin resin in MIBK was added to the pH mixture. After 10 minutes of the preliminary mixing, the mixture was emulsified so as to make the average particle diameter of the droplet to 0.35 μm with a high pressure emulsifying appratus. By the way, the viscosity of the solution of the p-phenylphenol-formalin resin was 8.2 cps and the viscosity of the aqueous solution was 4.4 cps, both at 70° C.

Into a flask, 250 parts of the emulsified liquid were introduced, and the solvent was removed therefrom by heating the liquid under an agitation and a reduced pressure for 3 hours.

The obtained slurry of p-phenylphenol-formalin resin had a solid part of 23% and a viscosity of 18 cps at 60° C., and on observing with a scanning electron microscope, the average diameter of the particles of the slurry was 0.3 μm.

The slurry was applied on a high quality sheet of 1 paper (40 g/m$^2$) so as to leave p-phenylphenol-formalin resin in a rate of 1.0 g/m$^2$ with a mayer bar. The coated sheet of paper was dried to obtain a sheet of the color-developer.

EXAMPLE 2

In the same manner as in Example 1 except for dissolving 40 parts of zinc 3,5-di-t-butylsalicylate (made by YOSHITOMI SEIYAKU Co. ) in 60 parts of MIBK instead of 50 parts of p-phenylphenol-formalin resin in 50 parts of MIBK, a sheet of the color-developer was obtained.

EXAMPLE 3

In the same manner as in Example 1 except for using the materials shown in Table 1 instead of ethylenemaleic anhydride copolymer, sodium polyoxyethylene alkylphenol ether sulfate and MIBK, a series of sheets of the color-developer were obtained.

EXAMPLE 4

In the same manner as in Example 1, a slurry of p-phenylphenol-formalin resin containing 23% of a solid matter was obtained.

Separately, water was added to 20 parts of zinc oxide, 80 parts of light calcium carbonate (made by SHIRAISHI Industry Co., under the name of HAKUENKA PZ) and 12 parts of 10% sodium metaphosphate to form an aqueous 30% slurry, and the solid in the slurry was pulverized and dispersed for 24 hours with a ball mill, and made to be a 20% slurry of inorganic materials by further adding water thereto.

The slurry of p-phenylphenol-formalin resin was mixed with the slurry of inorganic materials, and 200 parts of an aqueous 10% solution of polyvinyl alcohol were added to the mixture. The resulted mixture was applied on a high quality sheet of paper (40 g/m$^2$) with a mayer bar so as to leave 1.0 g/m$^2$ of p-phenylphenol-formalin resin on the sheet. The sheet was dried to obtain a sheet of the color-developer.

EXAMPLE 5

In the same manner as in Example 2, a slurry of zinc 3,5-di-t-dubylsalicylate was obtained. Separately, water was added to 20 parts of zinc oxide, 30 parts of light calcium carbonate (made by SHIRAISHI Industry Co., under the name of HAKUENE PZ) and 5 parts of 10% sodium metaphosphate to form an aqueous 25% slurry, and the solid in the slurry was pulverized and dispersed for 24 hours with a ball mill and made to a 20% slurry of inorganic materials by further adding water thereto.

TABLE 1

| Example | 1 | 3-1 | 3-2 | 3-3 | 3-4 | 3-5 | 3-6 |
|---|---|---|---|---|---|---|---|
| 10% LEVENOL WZ | 18 | — | — | 18 | 18 | 18 | 18 |
| 10% NPX | — | 20 | — | — | — | — | — |
| 10% LEVENOL WX | — | — | 18 | — | — | — | — |
| 5% EMA-21 | 50 | 50 | 50 | — | — | — | 50 |
| 10% PVA-105 | — | — | — | 25 | — | — | — |
| 5% CMC | — | — | — | — | 40 | — | — |
| 5% MC | — | — | — | — | — | 50 | — |
| Water | 180 | 180 | 180 | 205 | 190 | 180 | 180 |
| Color-developer resin | 50 | 50 | 50 | 50 | 50 | 50 | 50 |
| MIBK | 50 | 50 | 50 | 50 | 50 | 50 | — |
| Toluene | — | — | — | — | — | — | 50 |
| pH | 4.0 | 4.0 | 4.0 | 8.0 | 6.0 | 5.0 | 4.0 |

Notes:
(1) LEVENOL WZ = sodium polyoxyethylene alkyl phenol ether sulfate;
(2) NPX = sodium dodecylbenzenesulfonate;
(3) LEVENOL WX = sodium polyoxyethylene alkyl ether sulfate;
(4) EMA-21 = ethylene-maleic anhydride copolymer;
(5) PVA-105 = polyvinyl alcohol;
(6) CMC = carboxymethylcellulose;
(7) MC = methylcellulose;
(8) Color-developer resin = p-phenylphenol-formalin resin;
(9) MIBK = methyl isobutyl ketone;
(10) pH is the pH of the aqueous solution (continuous phase) in the emulsion.

The slurry of zinc 3,5-di-t-butylsalicylate was mixed with the slurry of inorganic materials, and 150 parts of an aqueous 10% solution of polyvinyl alcohol were added to the mixture. The mixed slurry was applied on a high quality sheet of paper (40 g/m$^2$) with a mayer bar so as to leave 1.0 g/m$^2$ of zinc 3,5-di-t-butylsalicylate on the sheet of paper. The sheet of paper was dried to obtain a sheet of the color-developer.

COMPARATIVE EXAMPLE 1

A commercial sheet of color-developer (made by JUJOSEISHI CO., under the trade mark of NW40B) using conventional p-phenylphenol-formalin resin was prepared. The diameter of the particles of the color-developer was 0.3 to 11.5 μm in was 2.3 μm in average. The amount of the color-developer on the sheet was 0.7 g/m$^2$ as p-phenylphenol-formalin resin.

COMPARATIVE EXAMPLE 2

To 15 parts of p-phenylphenol-formalin resin (made by GUNEI KAGAKU Co., under the mark of PS-2881), 10 parts of an aqueous 10% solution of polyvinyl alcohol, 0.5 part of an aqueous 10% solution of sodium polyoxyethylene alkylphenol ether sulfate and water were added to prepare an aqueous 30% slurry. When the solid in the slurry was pulverized for 24 hours with a ball mill, a slurry containing particles of a diameter in the range of 0.5 to 13 μm and of a mean diameter of 3.3 μm was obtained.

To the slurry, 40 parts of an aqueous 10% solution of polyvinyl alcohol and water were added to make the solid content 20%.

The resulted slurry was applied on a high quality sheet of paper (40 g/m$^2$) so as to leave p-phenylphenol-formaldehyde resin in a rate of 1.0 g/m$^2$. The sheet of paper was dried to obtain a sheet of the color-developer.

COMPARATIVE EXAMPLE 3

Emulsification was carried out in the same composition and under the same conditions as in Example 1 to obtain a slurry, and without carrying out the removal of the solvent in the slurry, the slurry was applied on a high quality sheet of paper (40 g/m$^2$) so as to leave 1.0 g/m$^2$ of p-phenylphenol-formalin resin. The sheet of paper was dried to obtain a sheet of the color-developer. During a drying step, an odor of MIBK was recognized, however, no odor was recognized on the final sheet of the color-developer itself.

EXAMPLE 6

(Performance tests of the sheets of color-developer):

This Example shows the test methods and their results of the sheets of color-developer obtained in Examples and Comparative Examples.

The tests being carried out as follows.

(1) Speed of Color Development

The coated surface of an upper sheet of paper was placed on the sheet of color-developer obtained in Examples or Comparative Examples, and a load of 200 kg/cm$^2$ was applied on the piled sheets by a calender roll to develop a color.

The color concentrations of the developed image were measured by a reflection densitometer (made by Macbeth, a division of Kallmorgen Co., model RD-100R) through a visual filter after 30 seconds and 24 hours of the color-development, respectively.

The speed of color development (A) was calculated with the following formula:

$$A = \frac{\text{Concentration after 30 seconds}}{\text{Concentration after 24 hours}}$$

Further, the upper sheet of paper used in this test was made by FUJI FILM Co., Ltd., under the mark of CN 40.

(2) Light-Resistance of the Colored Image

The sheet of color-developer which had been subjected to 24 hours' test of test (1), was exposed to sun light for 4 hours. The remaining color concentration of the developed image was measured by the reflection densitometer (model RD-100R) and the light-resistance of the colored image was defined by the following formula:

$$B = C/D$$

wherein

B is the light-resistance of the colored image;

C is the color concentration of the developed image after exposing to sun light and D is the color concentration of the developed image before exposing to sun light.

(3) Yellowing Property of the Sheet of Color-Developer

The coated surface of a sheet of color-developer was exposed to sun light for 4 hours, and the concentration of the color before or after the exposure was measured by a refractivity meter (made by TOKYO DENSHOKU Co., model TC-6D) by using each filter of amber, blue and green. The extent of yellowing was obtained according to the following formula:

$$\text{Extent of yellowing} = (Am - B)/C$$

wherein Am, B and C mean the value measured by using each filter of amber, blue and green, respectively.

All the test results are shown in Table 2.

TABLE 2

| Example | Speed of color development | Light-resistance of image | Extent of yellowing Before | Extent of yellowing After |
|---|---|---|---|---|
| 1 | 0.91 | 0.86 | 0.040 | 0.059 |
| 2 | 0.93 | 0.84 | 0.034 | 0.050 |
| 3-1 | 0.90 | 0.86 | 0.043 | 0.060 |
| 3-2 | 0.91 | 0.85 | 0.040 | 0.058 |
| 3-3 | 0.90 | 0.85 | 0.042 | 0.059 |
| 3-4 | 0.88 | 0.86 | 0.041 | 0.060 |
| 3-5 | 0.89 | 0.86 | 0.043 | 0.061 |
| 3-6 | 0.91 | 0.86 | 0.041 | 0.058 |
| 4 | 0.88 | 0.87 | 0.048 | 0.057 |
| 5 | 0.91 | 0.85 | 0.044 | 0.053 |
| Com. Ex. 1 | 0.76 | 0.85 | 0.084 | 0.096 |
| Com. Ex. 2 | 0.70 | 0.84 | 0.043 | 0.058 |
| Com. Ex. 3 | 0.88 | 0.82 | 0.045 | 0.091 |

Note:
In the above Table; Before means Before exposure to sun light After means After exposure to sun light Com. Ex. means Comparative Example.

As are shown in Table 2, the sheet of the color-developer produced according to the present invention has a rapid speed of color-development and is excellent in the light-resistance and the extent of not yellowing.

What is claimed is:

1. A process for producing a sheet of a color-developer for pressure-sensitive recording paper, which process comprises the steps of:

dissolving an organic color-developer in an organic solvent which has a boiling point of not higher than 170° C. under atmospheric pressure or forms an azeotropic mixture with water, is not dissolved in water to the extent of more than 5 wt% at ordinary temperature and dissolves said organic color-developer to the extent of more than 10 wt% at a heating temperature at which said organic solvent is removed from said liquid droplets, adding the solution of the color-developer into an aqueous solution dissolving a surfactant and a water-soluble high polymer in an amount of not less than 0.2 parts by weight and not more than 50 parts by weight of said solution of the color-developer, emulsifying the resulting mixture thereby forming minute liquid droplets with a diameter of from 0.01 to 2 μm comprising said solution of the color-developer, then heating the liquid emulsion under agitation, thereby removing said organic solvent from said liquid droplets, and obtaining an aqueous slurry of said color-developer, and finally applying the aqueous slurry of said color-developer onto a supporting sheet.

2. The process for producing a sheet of a color-developer according to claim 1, wherein said organic solvent is selected from the group consisting of benzene, toluene, trichloroethane, dichloroethane, chloroform, carbon tetrachloride, methyl isobutyl ketone, diethyl ketone, n-butyl acetate, isobutyl acetate and mixtures thereof.

3. The process for producing a sheet of a color-developer according to claim 1, wherein said surfactant is selected from the group consisting of a salt of alkylbenzenesulfonic acid, a salt of dialkylsulfosuccinic acid, a salt of alkylsulfuric acid, a salt of polyoxyethylene alkyl ethersulfuric acid and a salt of polyoxyethylene alkylphenol ethersulfuric acid.

4. The process for producing a sheet of color-developer according to claim 1, wherein said water-soluble high polymer is selected from the group consisting of polyvinyl alcohol, a copolymer of styrene and maleic anhydride, a copolymer of ethylene and styrene, methylcellulose, hydroxyethylcellulose, a carboxymethylcellulose and a resin of an acrylic ester.

5. The process for producing a sheet of a color-developer according to claim 1, wherein the weight ratio of said surfactant to said water-soluble high polymer is in the range of 0.2 to 4.

6. The process for producing a sheet of a color-developer according to claim 1, wherein said solution of said color-developer is added to water in an amount of 10 to 140% of water and resulting mixture is emulsified.

7. The process for producing a sheet of a color-developer according to claim 1, wherein the ratio of the viscosity of said solution of color-developer to the viscosity of said aqueous solution is in the range of 0.1 to 10 at the temperature of emulsification.

* * * * *